US005897684A

United States Patent [19]

Kim et al.

[11] Patent Number: 5,897,684

[45] Date of Patent: Apr. 27, 1999

[54] BASIC OXYGEN PROCESS WITH IRON OXIDE PELLET ADDITION

[75] Inventors: Chung S. Kim, Hudson, Ohio; Ken M. Goodson, Hammond, Ind.

[73] Assignee: LTV Steel Company, Inc., Cleveland, Ohio

[21] Appl. No.: 08/839,291

[22] Filed: Apr. 17, 1997

[51] Int. Cl.[6] ..... C21C 5/30

[52] U.S. Cl. ..... 75/387; 75/544

[58] Field of Search ..... 75/544, 387

[56] References Cited

U.S. PATENT DOCUMENTS

| | | |
|---|---|---|
| 3,169,058 | 2/1965 | Nelson . |
| 3,252,790 | 5/1966 | Krivsky . |
| 3,307,937 | 3/1967 | Pihlblad et al. . |
| 3,867,134 | 2/1975 | Shaw et al. . |
| 3,920,447 | 11/1975 | Schroeder et al. . |
| 3,953,199 | 4/1976 | Michaelis . |
| 3,960,546 | 6/1976 | Rote et al. . |
| 4,004,920 | 1/1977 | Fruehan . |
| 4,089,677 | 5/1978 | Spenceley et al. . |
| 4,149,878 | 4/1979 | Thokar et al. . |
| 4,210,442 | 7/1980 | Lewis, III et al. . |
| 4,308,057 | 12/1981 | Ono et al. . |
| 4,397,685 | 8/1983 | Maddever et al. . |
| 4,445,933 | 5/1984 | Saito et al . |
| 4,514,220 | 4/1985 | Tommaney et al. . |
| 4,615,730 | 10/1986 | Tommaney . |
| 5,374,297 | 12/1994 | Schlichting . |
| 5,431,710 | 7/1995 | Ebenfelt . |

FOREIGN PATENT DOCUMENTS

| | | | |
|---|---|---|---|
| 1471 733 | 1/1967 | France . | |
| 0158210 | 12/1980 | Japan . | |
| 0210230 | 8/1988 | Japan . | |
| 1132714 | 5/1989 | Japan . | |
| 1234513 | 9/1989 | Japan . | |
| 1560561 | 4/1990 | Russian Federation | 75/544 |
| 1810834 | 3/1981 | U.S.S.R. . | |
| 1507807 | 9/1989 | U.S.S.R. . | |

*Primary Examiner*—Melvyn Andrews

*Attorney, Agent, or Firm*—Watts, Hoffmann, Fisher & Heinke, Co., L.P.A.

[57] ABSTRACT

A BOF process in which iron oxide units are added to the melt during the blow characterized in that the oxygen flow is reduced during pellet feeding and is replenished with inert gas so that the total gas flow remains the same as that designed to achieve optimum BOF performance.

3 Claims, No Drawings

BASIC OXYGEN PROCESS WITH IRON OXIDE PELLET ADDITION

BACKGROUND OF THE INVENTION

This invention relates generally to the basic oxygen process of melting and refining steel, and more specifically to a new mixed gas blowing technique in which iron oxide containing material is added to the melt during the blow.

Mixed gas blowing (oxygen and an inert gas) has been used in the BOF process for various reasons. U.S. Pat. No. 4,210,442, the disclosure of which is incorporated by reference, discloses a basic oxygen refining process in which argon is blown into the melt with the oxygen in order to prevent slopping caused by the evolution of carbon monoxide. As discussed in this patent, silicon, manganese, etc. are preferentially oxidized in the initial stage of the blow. After the metallic impurities are oxidized, more oxygen is available for reaction with the carbon in the melt and this results in increased evolution of carbon monoxide. It is at this stage of greater carbon monoxide evolution that slopping is likely to occur. According to U.S. Pat. No. 4,210,442, argon is then blown into the melt with the oxygen until slopping has stopped. In the illustrative examples of the process disclosed in the patent, the initial oxygen flow rate is maintained when injecting the argon.

U.S. Pat. No. 4,514,220 discloses a mixed gas blowing process used to make stainless steel in a top-blown vessel having a hot metal charge that forms the bath. The process involves introducing an inert gas beneath the surface of the charge throughout the blow. After the top blowing has commenced, an inert gas is injected with the oxygen while decreasing its flow rate. The bottom inert gas flow is used to produce stirring of the bath, while the top blown inert gas is used to dilute carbon monoxide formed during decarburization of the melt.

Mixed gas blowing also has been used to minimize oxidation of chromium in the production of stainless steel, to produce low nitrogen steels, and for degassing. In still another process disclosed in U.S. Pat. No. 5,374,297, a stream of inert gas is used when a carbonaceous fuel is introduced into the furnace with the oxygen. An inert gas is injected between the fuel and the oxygen stream to prevent premature combustion.

There has existed a need for a process that would facilitate the introduction of iron oxide containing material during the blow while maintaining optimum furnace performance. When iron oxide is added to the melt, the evolution of carbon monoxide is increased as the iron oxide is reduced. A conventional practice has been to reduce the oxygen flow when adding iron ore pellets to the melt. This reduction in the flow of oxygen during blowing has several disadvantages. The reduced jet momentum and penetration into the bath generates more iron oxide in the slag in addition to the iron oxides already introduced by the feed material. Also, the reduction of oxygen flow reduces the turbulence of the bath which in turn reduces the rate of melting and reaction of the iron ore or oxides, thereby adversely affecting performance of the BOF.

SUMMARY OF THE INVENTION

The present invention provides an improvement to the basic oxygen process which utilizes a mixed gas blowing technique that makes it possible to add iron oxide units during the blow without affecting optimum performance of the BOF. In a preferred embodiment, the method of the invention comprises the steps of feeding iron oxide containing material into the BOF after the blow has commenced, and introducing an inert gas while feeding the iron oxide containing material in order to reduce the evolution of carbon monoxide and consequent slopping, the step of introducing the inert gas being carried out by reducing the volume flow rate of oxygen during feeding and replenishing the gas stream with an inert gas in an amount sufficient to maintain the designed integrity of the jet.

In carrying out the method, the oxygen is reduced while feeding the iron units to the melt by an amount sufficient to prevent slopping resulting from the evolution of carbon monoxide caused by the combined effects of reducing the iron oxide and oxidizing the carbon in the melt. In addition to prevent slopping, the method avoids high carbon monoxide contents in the offgas and/or high hood pressures. The important feature of replenishing the reduced oxygen flow with inert gas in an amount sufficient to maintain the designed integrity of the jet stream assures that penetration of the gas jet into the bath and bath turbulence are not reduced. This avoids the problems of reduced melting rate, reduced reaction with the iron oxides, and increased iron oxide in the slag resulting from the conventional practice of simply turning down the oxygen flow during pellet feeding.

By promoting the ability to add low cost iron oxide containing material during the blow, the method of the invention reduces the need for higher cost scrap additions and dependence on hot metal from the blast furnace while still maintaining the productive capacity of the vessel. The reduction in the need for scrap and hot metal greatly enhances the flexibility of the BOF process. For example, by reducing the need for hot metal during slab casting, it is possible to produce hot metal as repeatedly and economically as possible. In addition to cost savings, the reduction in the need for scrap with its inherent compositional variability improves the operator's ability to control chemistry and produce higher quality heats of steel.

DETAILED DESCRIPTION

The method of the present invention is directed to a BOF process wherein iron oxide units are fed into the melt during the blow. As generally discussed above, the addition of iron oxide to the melt increases the danger of excessive evolution of carbon monoxide and slopping. This danger is overcome by reducing the oxygen flow during feeding and replenishing the gas stream with an inert gas so that the total flow remains substantially the same as that designed to maintain the integrity of the jet with resulting maximum penetration and turbulence of the melt.

The invention can be practiced using nitrogen and argon as the inert gas. When using nitrogen the blowing should be controlled to avoid dissolving excessive amounts in the bath and thereby exceeding the nitrogen specification. Nitrogen pickup depends both on the amount of nitrogen gas that is blown and the time of finishing the injection of nitrogen during the blowing cycle. It has been found that nitrogen injection early in the blow minimizes nitrogen pickup in the steel, probably because the rate of absorption is lower at lower bath temperatures. In addition, subsequent carbon monoxide gas generation will flush out some of the nitrogen from the bath. For low nitrogen content grades of steel or for extended times of inert gas blowing, argon can be used as the inert gas during either the entire mixed gas blowing cycle or the latter part of it.

A particular advantage of the invention is that the new mixed gas blowing and pellet feeding technique can be practiced using existing melt shop equipment. As illustrative examples, fourteen heats of steel were made using an existing system capable of delivering oxygen flow at a normal rate of 26,200 SCFM and a pellet feed of 3,000 pounds per minute. A nitrogen enrichment system capable of injecting 5,200 SCFM was employed without modification.

When the system was turned on, the normal 26,200 SCFM oxygen flow rate was reduced to 21,200 SCFM and the difference in the oxygen flow rate replaced with nitrogen injected at a rate of 5,200 SCFM. The amount of pellet addition, duration of nitrogen blowing, and its timing were varied to obtain the data presented in the following table.

It was observed that no heat slopped when the system was on and that in some heats slopping stopped as soon as the system was turned on, thereby affirming that nitrogen flow and pellet feed are good slopping-suppressants. The excellent slopping performance observed in production of the fourteen heats prompted the addition of pellets in amounts up to 20,000 pounds continuing through the critical slopping period with the feed being started as early five minutes fifty seconds into the blow. A normal nitrogen pickup was experienced, e.g. 30 ppm at turndown versus 20 ppm for normal heats. On two heats, the nitrogen at turndown was intentionally increased, while on other heats it was higher because the nitrogen blow was unnecessarily prolonged due to irregularities of the pellet feeder, e.g. slow down or jamming. Sulphur control was good even without scrap segregation, since the normal sulphur input load from the typical scrap charge was reduced.

Based on the trial results, a preliminary analysis was made to predict the amounts of pellet addition allowable for three different levels of nitrogen content at turndown. The predicted amounts are included in the table. The quantity of pellets is calculated to include: (1) an initial charge with fluxes of 3,000 pounds, (2) an initial metered feed of 3,000 pounds per minute with the nitrogen enrichment, and (3) the final metered feed of 3,000 pounds per minute without nitrogen enrichment (total 5,000 pounds). The final metered feed can be made 300 to 352 oxygen units (approximately twelve to fourteen minutes) into the blow with little risk of slopping.

TABLE ($N_2$ Blow Commencing at 140 $O_2$ Units Where 1 Unit = 1000 SCF $O_2$ Consumed)

| $O_2$ Unit at End of $N_2$ Blow | Expected Pellet Consumption (lbs.) | Expected Nitrogen at Turndown (ppm) |
|---|---|---|
| 220 | 20,000 | 27 |
| 260 | 25,000 | 31 |
| 280 | 28,000 | 34 |

It will be apparent from the data present in Table 1 that the practice of the invention promises good pellet consumption throughout the blow and that the amount of pellet consumption will vary dependent upon the nitrogen content at turndown and the duration of the nitrogen blow.

Other features, advantages and a fuller understanding of the invention will be had from the following claims. It is to be understood that, within the scope of the appended claims the invention can be practiced otherwise than as described.

What is claimed is:

1. In a method of melting and refining molten steel by the BOF process wherein oxygen is blown down into the melt to refine the steel and an inert gas is blown down into the melt to prevent slopping, the improvements comprising the steps of:

a) feeding iron oxide containing material into the BOF after the blow has commenced, and b) introducing the inert gas while feeding the iron oxide containing material in order to reduce the evolution of carbon monoxide and consequent slopping, c) said step of introducing the inert gas being carried out by reducing the volume flow rate of oxygen during feeding and replenishing the reduced oxygen flow with inert gas in an amount such that the integrity of the jet flow and its penetration into the melt is substantially unchanged.

2. The method of claim 1 wherein the inert gas is blown into the BOF during the entire time of feeding the iron ore containing material.

3. The method of claim 1 or claim 2 wherein the inert gas and iron oxide material are introduced within five to ten minutes after starting the blow.

* * * * *